US005638594A

United States Patent [19]

Shinkawa et al.

[11] Patent Number: 5,638,594

[45] Date of Patent: Jun. 17, 1997

[54] METHOD FOR MANUFACTURING A TELESCOPIC ANTENNA FOR VEHICLES

[75] Inventors: Misao Shinkawa; Misao Kimura, both of Kanagawa, Japan

[73] Assignee: Harada Kogyo Kabushiki Kaisha, Tokyo, Japan

[21] Appl. No.: 393,448

[22] Filed: Feb. 23, 1995

Related U.S. Application Data

[62] Division of Ser. No. 162,309, Dec. 3, 1993, abandoned.

[30] Foreign Application Priority Data

Dec. 4, 1992 [JP] Japan ..... 4-325588

[51] Int. Cl.[6] ..... H01P 11/00

[52] U.S. Cl. ..... 29/600; 148/409; 148/410

[58] Field of Search ..... 29/600; 148/409, 148/410

[56] References Cited

FOREIGN PATENT DOCUMENTS

| | | |
|---|---|---|
| 61-179855 | 8/1986 | Japan . |
| 4-120248 | 4/1992 | Japan . |
| 5-171363 | 7/1993 | Japan . |

*Primary Examiner*—Carl J. Arbes

*Attorney, Agent, or Firm*—Koda and Androlia

[57] ABSTRACT

A multi-stage telescopic antenna for use in vehicles and a method for manufacturing such an antenna in which the antenna element, which comprises uppermost rod and conductive pipes, is free of any bending or breaking damage even if a large load is applied to the antenna element from a lateral direction, and there is no permanent deformation occurs even after the load is removed, so that the antenna element can always be maintained straight and smooth and stable extension and retraction can be executed.

At least the conductive pipes 12 through 14 are formed from a high-elasticity material obtained by heat-treating SUS 631. In the heat treatment, the material is heated at a standard temperature of 480° C.±5° C. and then gradually cooled.

1 Claim, 8 Drawing Sheets

METHOD FOR MANUFACTURING A TELESCOPIC ANTENNA FOR VEHICLES

This is a division of application Ser. No. 08/162,309, filed Dec. 3, 1993, now abandoned.

BACKGROUND OF THE INVENTION

1. Field of the Invention

The present invention relates to an antenna for use in vehicles which can be mounted on automobiles, etc. and more particularly to a multi-stage telescopic antenna for use in vehicles and to a method for manufacturing such an antenna in which the uppermost rod consisting of a solid rod and a plurality of conductive pipes are slidably connected to each other.

2. Prior Art

Generally, vehicle-mounted multi-stage telescopic antennas of this type are constructed in the following manner: an uppermost rod that is a solid rod and a plurality of conductive pipes of different diameters are connected to each other in a slidable fashion so that the thus obtained antenna element as a whole is extended and retracted by an antenna element extending and retracting rope that operates the uppermost rod to slide.

SUMMARY OF THE INVENTION

In view of the above, the object of the present invention is to provide a multi-stage telescopic antenna for use in vehicles in which no danger of bending or breaking of the uppermost rod and conductive pipes that make up the antenna element occurs even in cases where a large load is applied to the antenna element from a lateral direction and in which no permanent deformation remains in the antenna element even after the load is removed, so that the antenna element can keep itself straight and so that a smooth and stable extension and retraction operation of the antenna is secured. The present invention relates also to a method for manufacturing such an antenna.

In order to solve the problems and achieve the object, in the present invention a multi-stage telescopic antenna for vehicles that comprises an uppermost rod, which is a solid rod, and a plurality of conductive pipes with different diameters connected to each other in a slidable fashion, at least the conductive pipes are formed from a high-elasticity material obtained by heat-treating an SUS 631 material. The heat treatment is performed at a standard temperature of 480° C.±5° C., followed by gradual cooling. It is desirable that the surfaces of the conductive pipes and the solid rod be covered with a corrosion-resistant metal plating.

In addition, the multi-stage telescopic antenna for vehicles of the present invention is manufactured by the following steps:

- a pipe manufacturing process in which band-form pieces of SUS 631 material are curled into a pipe form and welded;
- a pipe shaping process in which the external diameter and the plate thickness of the pipes formed in the pipe manufacturing process are worked until a sum of "external diameter working rate" and "plate thickness working rate" is 20% or greater, and then the pipes are cut to prescribed lengths, thus shaping pipes; and
- a heat treatment process in which the pipes shaped in the pipe shaping process are heat-treated at a standard temperature of 480° C.±5° C. and then gradually cooled.

As a result of the means described above, the present invention has the following effects:

(1) At least the conductive pipes are formed from a high-elasticity material obtained by heat-treating the SUS 631. Accordingly, even if a large load is applied to the antenna element from a lateral direction which is a direction perpendicular to the axial direction of the antenna element, the antenna element as a whole can bend greatly like a fishing rod, and there is very little danger that the uppermost rod or conductive pipes making up the antenna element will suffer any bending or breaking damage. Furthermore, there is almost no permanent deformation of the antenna element that is caused by residual strain after the load has been removed. Thus, the antenna element can be straight, and a smooth extension and retraction of the antenna element is secured in a stable manner.

(2) Since the conductive pipes are worked at a working rate of 20% or greater, the tensile strength and proof stress of the conductive pipes are improved. Furthermore, since a prescribed heat treatment is additionally performed, the conductive pipes can have a sufficiently large elasticity. In addition, manufacture of the antenna element can be easy and relatively inexpensive.

BRIEF DESCRIPTION OF THE DRAWINGS

The above-mentioned features and objects of the present invention will become more apparent with reference to the following description taken in conjunction with the attached drawings in which like numerals denote like elements and in which.

DETAILED DESCRIPTION OF THE INVENTION

Figure 1:
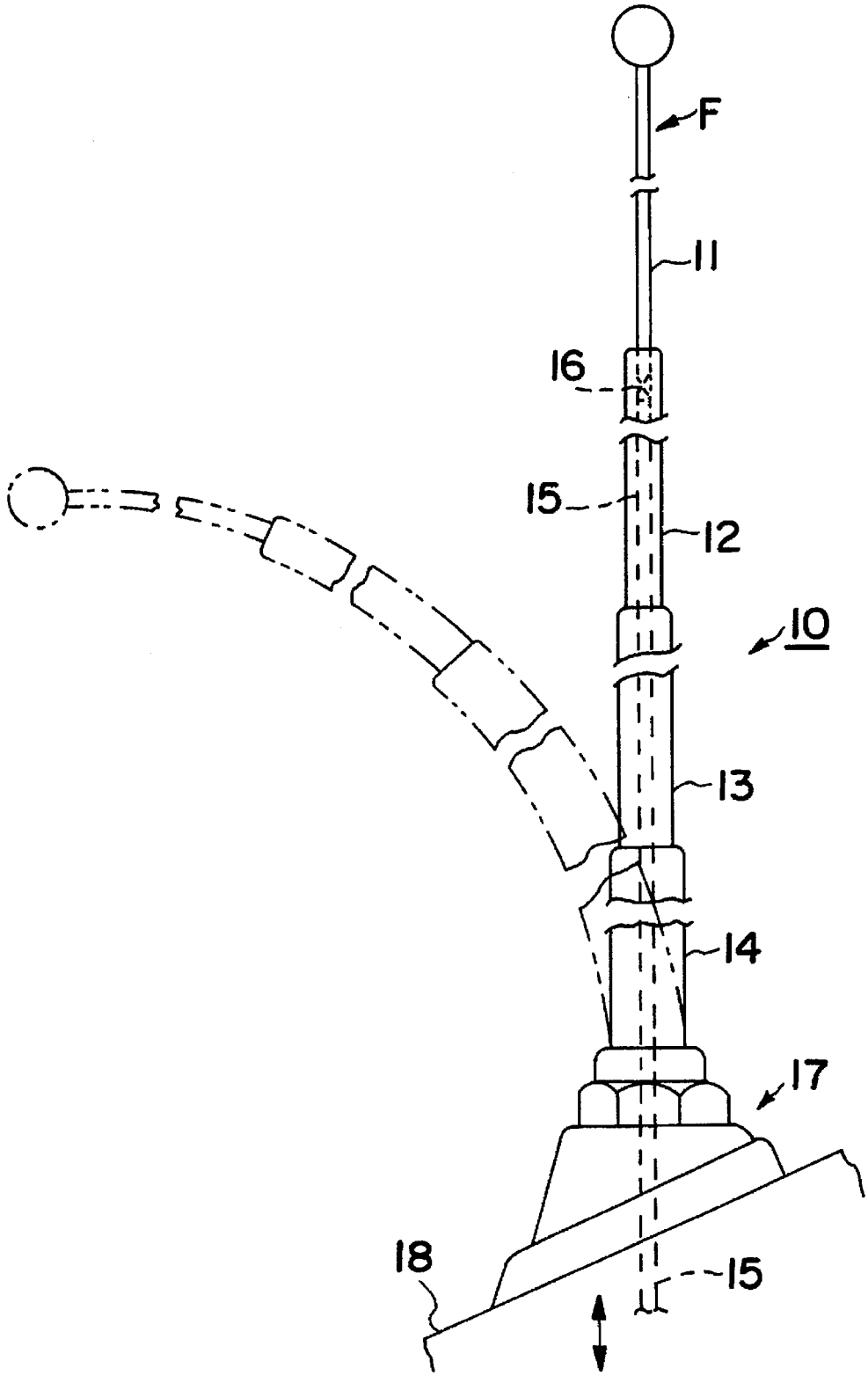
FIG. 1 is a side view of the construction of one embodiment of a multi-stage telescopic antenna for use in vehicles provided by the present invention.

FIG. 1 is a side view illustrating the structure of one embodiment of the multi-stage telescopic antenna for use in vehicles according to the present invention. As shown in FIG. 1, the antenna element 10 comprises an uppermost rod 11 consisting of a conductive solid rod and a plurality of conductive pipes, three in this embodiment, 12, 13 and 14, which are connected to each other in a manner that the solid rod and the pipes are free to slide. The tip end of a plastic rack-equipped rope 15 which is used to extend and retract the antenna element 10 is connected to the base end of the uppermost rod 11 via a cylindrical joint 16. In the Figure, 17 is an antenna mount, and 18 is a part of the vehicle body. The rack of the plastic rack-equipped rope 15 engages with a pinion (not shown) which is coupled to a motor inside the vehicle body via a relay gear. Accordingly, when the pinion rotates, the plastic rack-equipped rope 15 is fed upward or downward as indicated by the arrow, and as a result of this action, the uppermost rod 11 and the respective conductive pipes 12 through 14 connected to the rod 11 are caused to slide upward or downward. Thus, the antenna element 10 is extended or retracted.

The uppermost rod 11 and the conductive pipes 12 through 14 can bend as a whole as indicated by the broken lines in response to a load F which is applied from a direction that crosses the axial line of the antenna element. More specifically, the uppermost rod 11 and the conductive pipes 12 through 14 are made of a high-elasticity material which does not show any residual strain when the load F is removed. In this embodiment, the material used as the high-elasticity material is obtained by treating SUS 631 by heat at a standard temperature of 480° C.±5° C. and then gradually cooled. Furthermore, the outer surfaces of the respective antenna elements are polished and then plated with a metal.

The conductive pipes 12 through 14 are manufactured by the following processes:

(1) Pipe Manufacturing Process

Band-form pieces of SUS 631 are curled into pipe form, and the ends of each piece are welded together.

(2) Pipe Shaping Process

The external diameter and plate thickness of each one of the pipes formed in the pipe manufacturing process are worked so that the sum of the "external diameter working rate" and the "plate thickness working rate" is 20% or greater, after which the pipes are cut into prescribed lengths.

The "external diameter working rate" is expressed by the following formula wherein the external diameter D of a pipe is converted into a pipe of external diameter d by being passed through a die:

$$(D-d)/D=K1(\%)$$

In addition, the "plate thickness working rate" is expressed by the following formula wherein the plate thickness T of a pipe is converted into a pipe with a plate thickness of t by being passed through a die which has a center plug:

$$(T-t)/T=K2(\%)$$

(3) Heat Treatment Process

The pipes shaped in the pipe shaping process are heat-treated at a standard temperature of, for example, 480° C.±5° C. and then gradually cooled.

(4) Surface Treatment Process

The outer surfaces of the heat-treated pipes are polished and then covered with a corrosion-resistant metal plating such as a hard chrome plating, a black chrome plating, etc.

The antenna element 10 in this embodiment, which is constructed as described above, has an elasticity that can allow considerable bending. Consequently, even if a large load F is applied from one direction during, for example, washing of the vehicle, the antenna element as a whole is able to bend greatly like a fishing rod, and then the force resulting from the load escapes. Accordingly, there is very little danger that the uppermost rod 11 or the conductive pipes 12, 13 and 14 making up the antenna element 10 will suffer any bending or breaking damage. Moreover, the antenna element 10 shows almost no permanent deformation due to residual strain. Thus, the antenna element 10 can always be kept straight, and a smooth extension and retraction is performed in a stable fashion.

The external diameter and plate thickness of the conductive pipes 12 through 14 are worked so that the sum of the "external diameter working rate" K1 and "plate thickness working rate" K2 is 20% or greater; thus, the tensile strength and proof stress of the pipes are improved. In addition, the pipes are heat-treated at a standard temperature of 480° C.±5° C. and then subjected to a gradual cooling. Accordingly, pipes with a sufficiently large elasticity can be manufactured relatively easily and inexpensively.

(1) Samples a. Three-stage mast A of the present invention

Material: SUS 631

Heat treatment: 480° C.±5° C., 1 hour

Size: A b. Three-stage mast B of the present invention

Material: SUS 631

Heat treatment: 480° C.±5° C., 1 hour

Size: B c. Four-stage mast A of the present invention

Material: SUS 631

Heat treatment: 480° C.±5° C., 1 hour

Size: A d. Four-stage mast B of the present invention

Material: SUS 631

Heat treatment: 480° C.±5° C., 1 hour

Size: B e. Existing (conventional) three-stage mast A

Material: SUS 304

Size: A f. Existing (conventional) four-stage mast A

Material: SUS 304

Size: A

Here, size A ("diameter ϕ"×"plate thickness t"×"length l") is as follows:

No. 2 rod: ϕ 5.1×0.3 t×215 l

No. 3 rod: ϕ 6.7×0.4 t×217 l

No. 4 rod: ϕ 8.5×0.5 t×205 l

Similarly, size B is as follows:

No. 2 rod: ϕ 5.5×0.5 t×215 l

No. 3 rod: ϕ 7.2×0.5 t×217 l

No. 4 rod: ϕ 9.0×0.5 t×205 l (2) Test Methods

Figure 2:
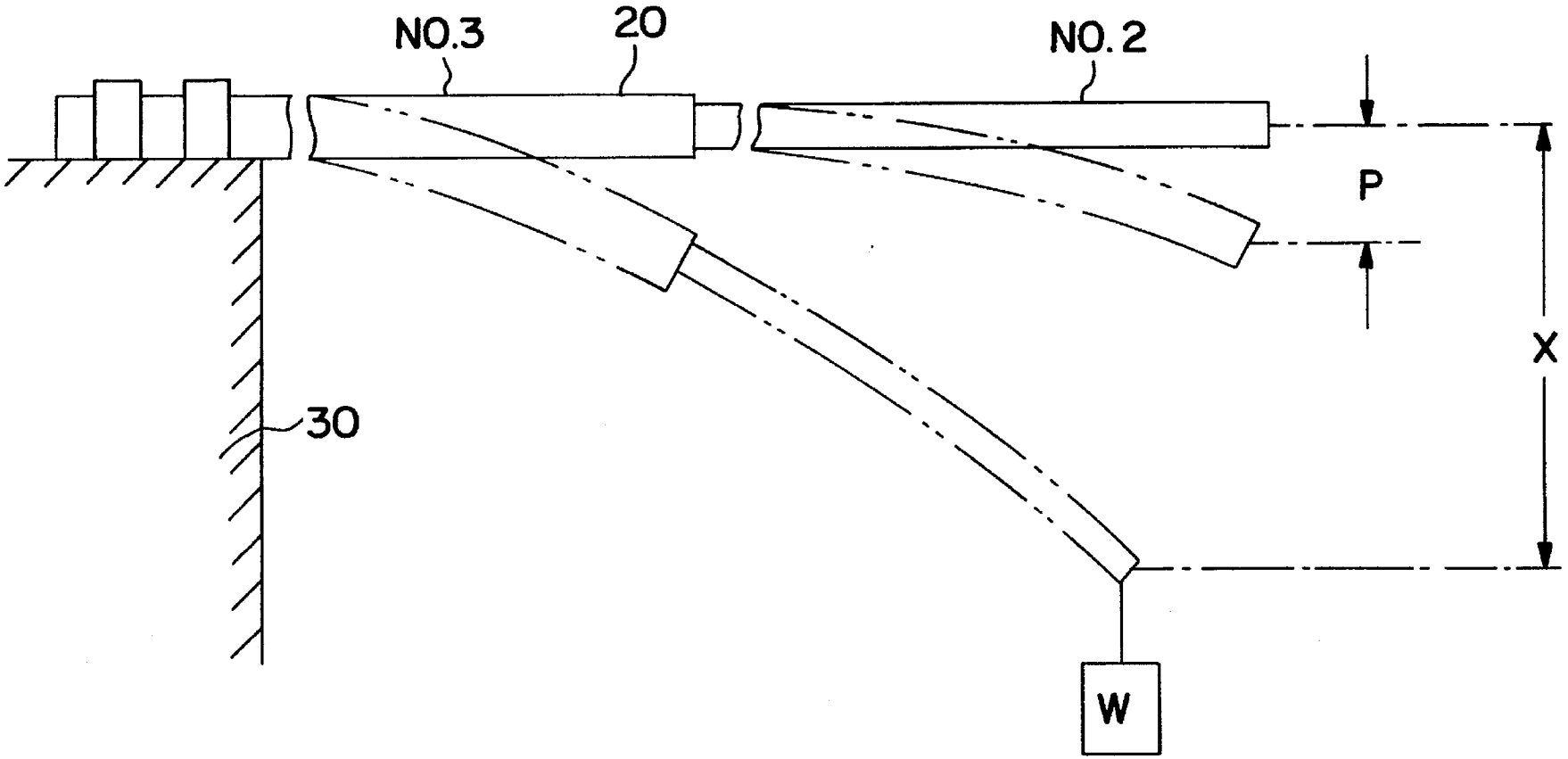
FIG. 2 is a schematic diagram illustrating the test method used in the test examples of the present invention.
Figure 3:
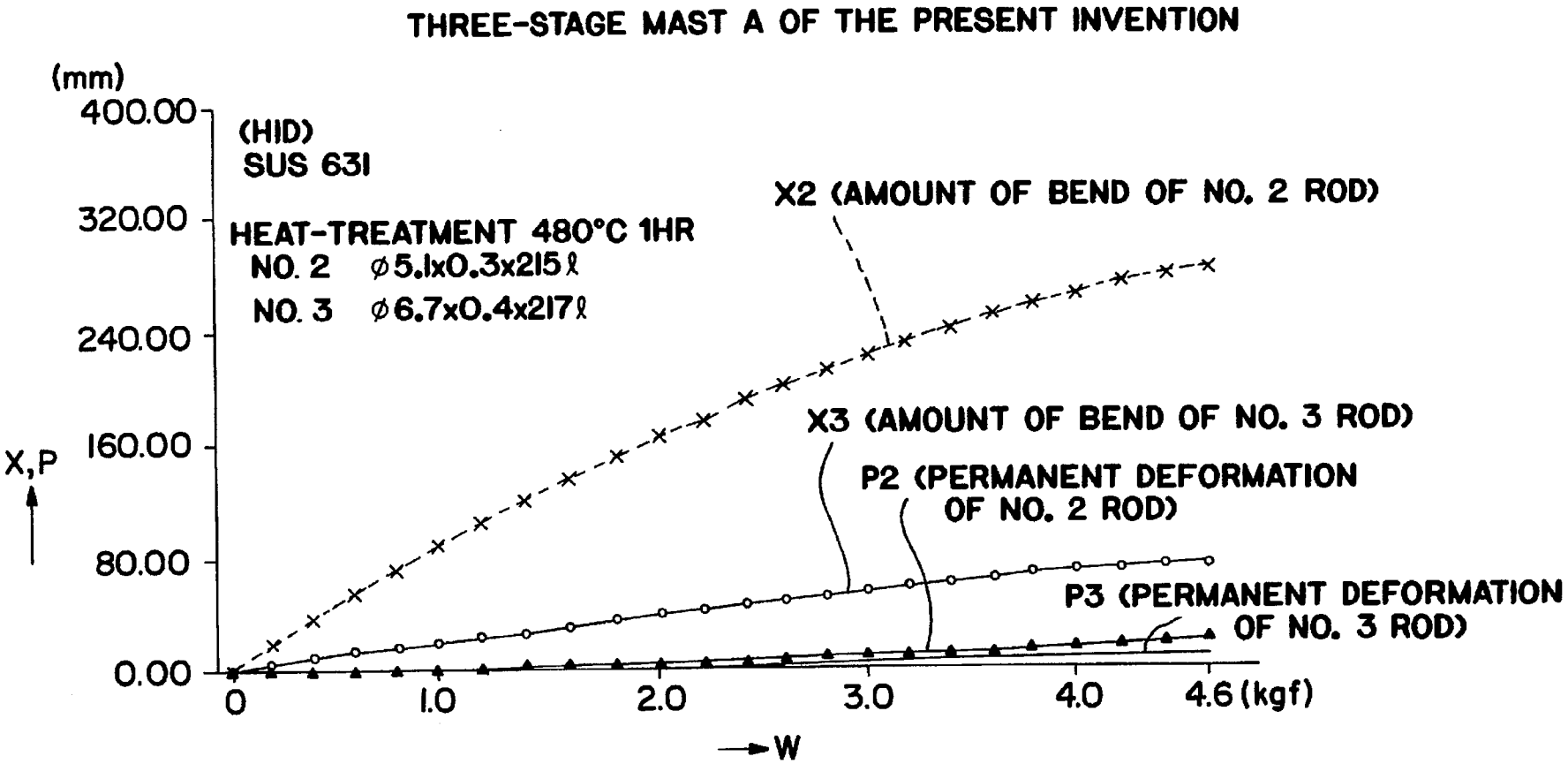
FIG. 3 is the test results from sample a of the embodiment of the present invention.
Figure 4:
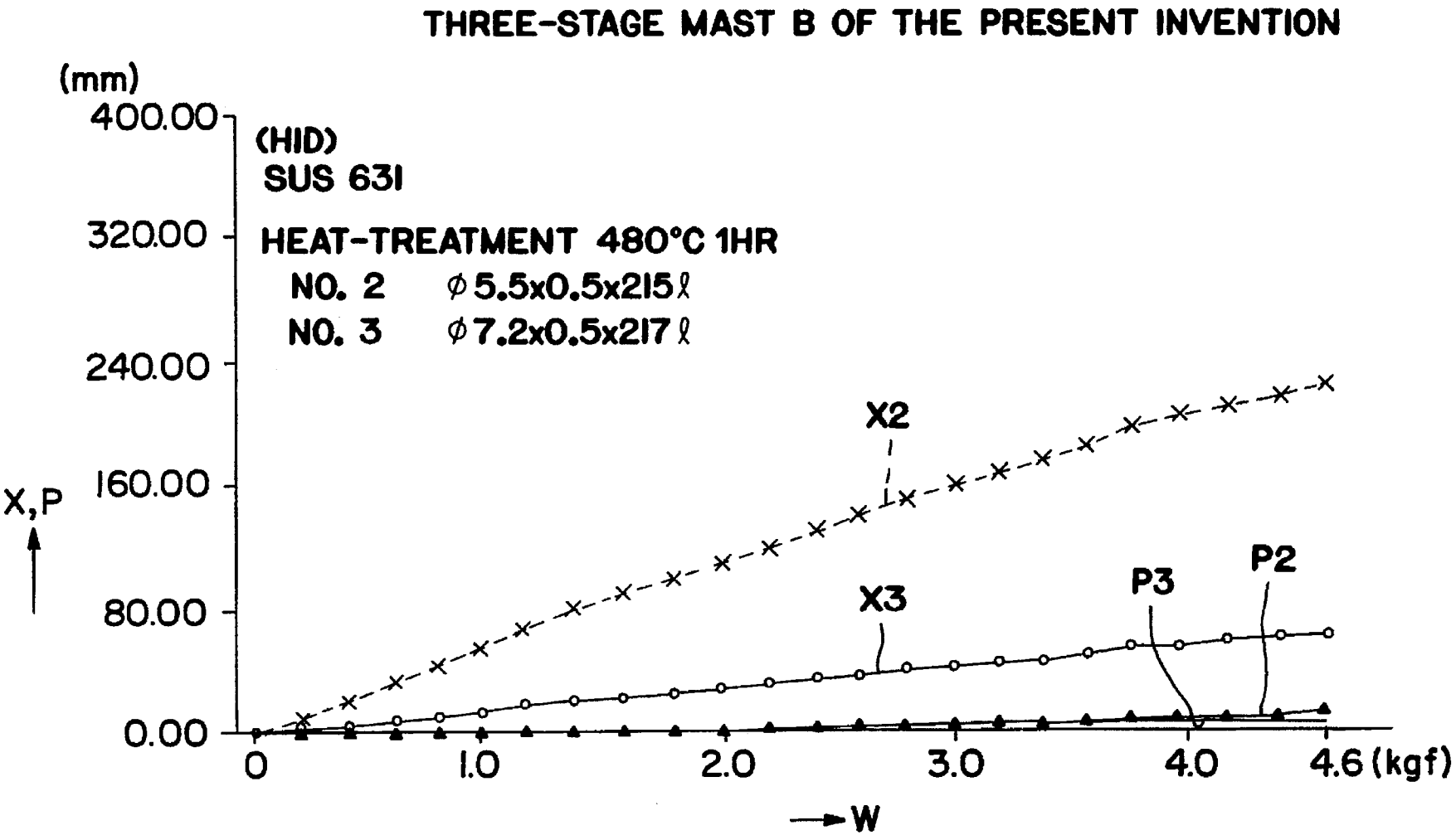
FIG. 4 is the test results obtained from sample b of the embodiment of the present invention.
Figure 5:
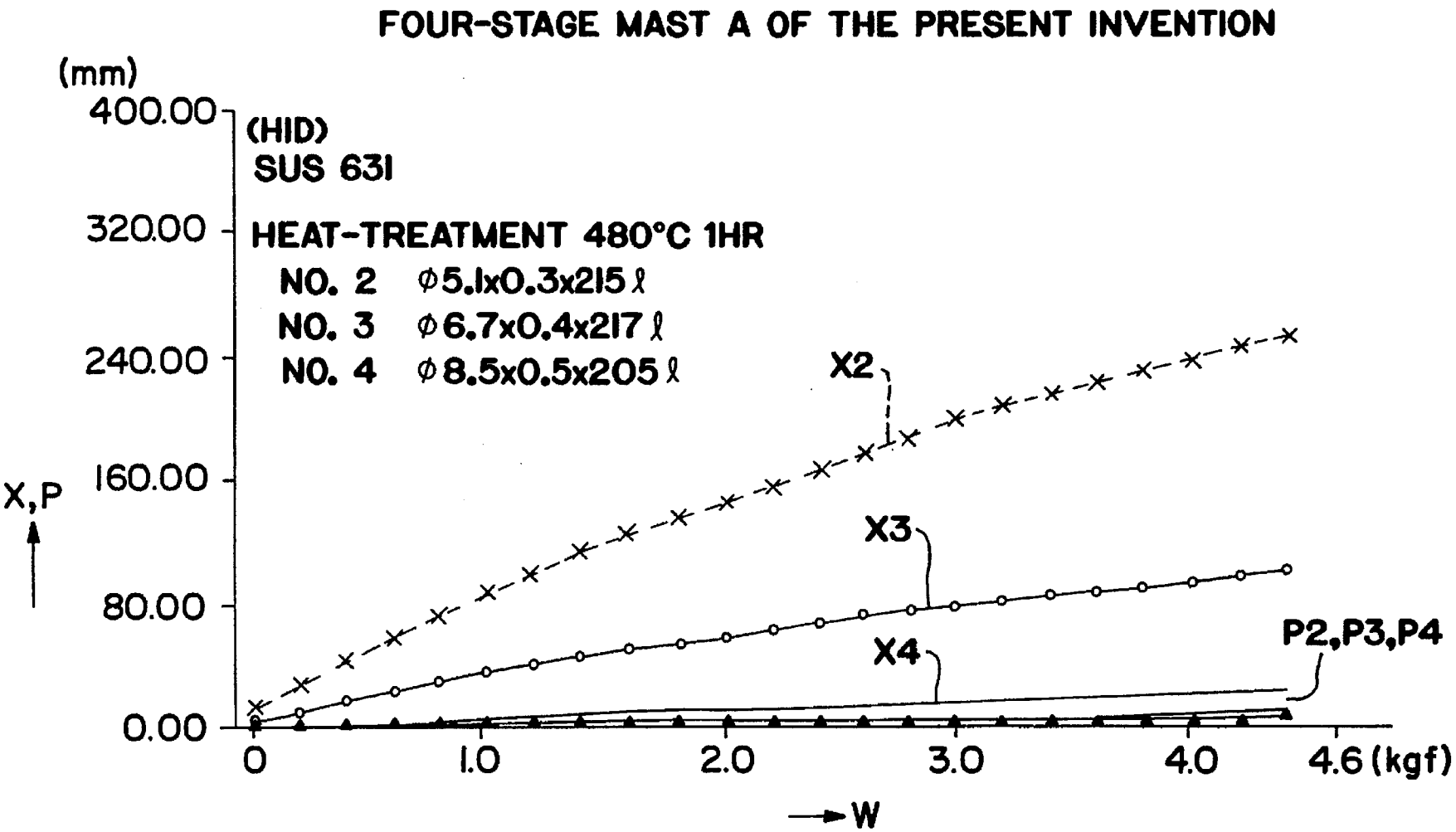
FIG. 5 is the test results obtained from sample c of the embodiment of the present invention.
Figure 6:
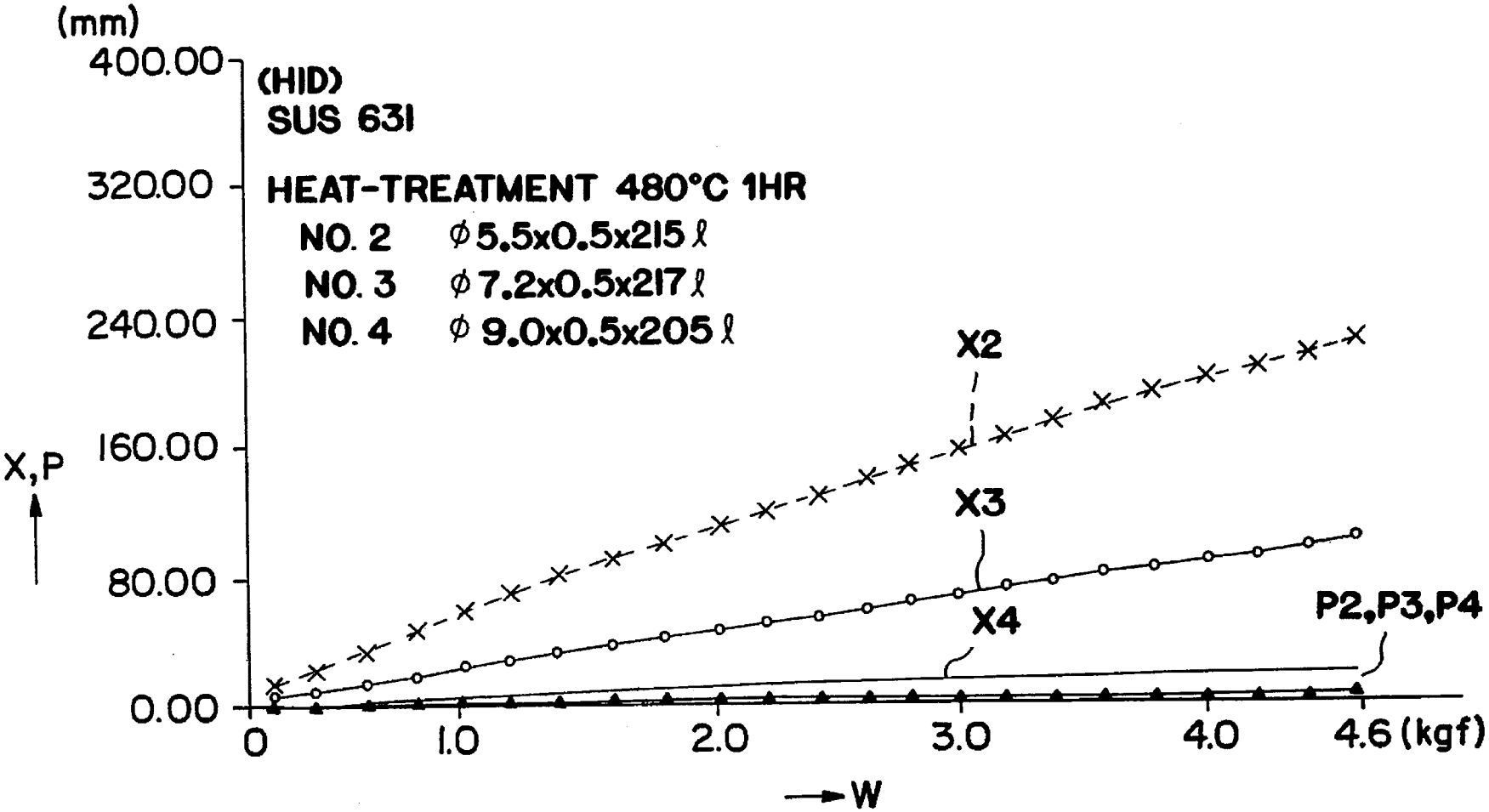
FIG. 6 is the test results obtained from sample d of the embodiment of the present invention.
Figure 7:
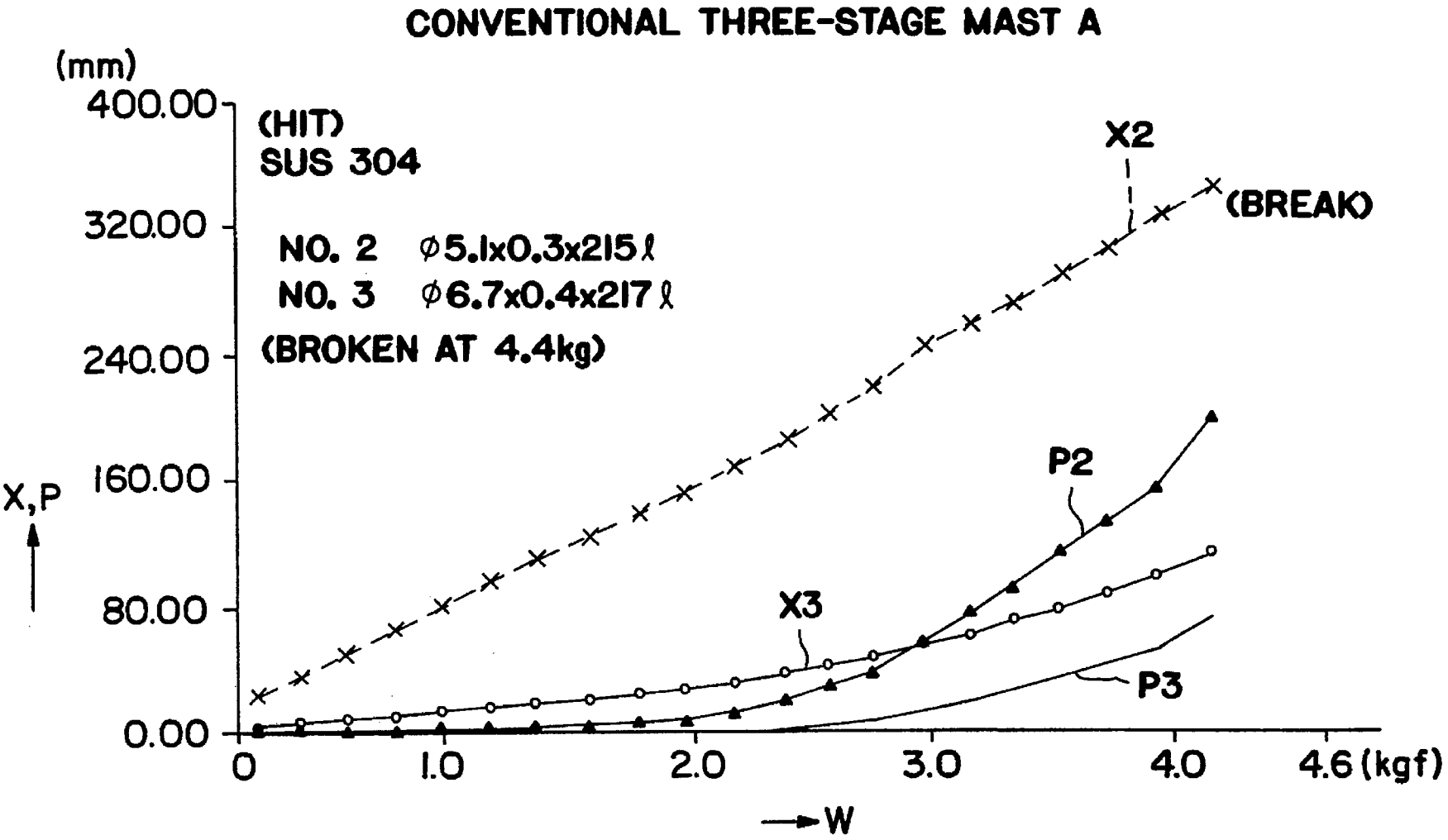
FIG. 7 is the test results obtained from sample e, which is a conventional sample, performed for the embodiment of the present invention.
Figure 8:
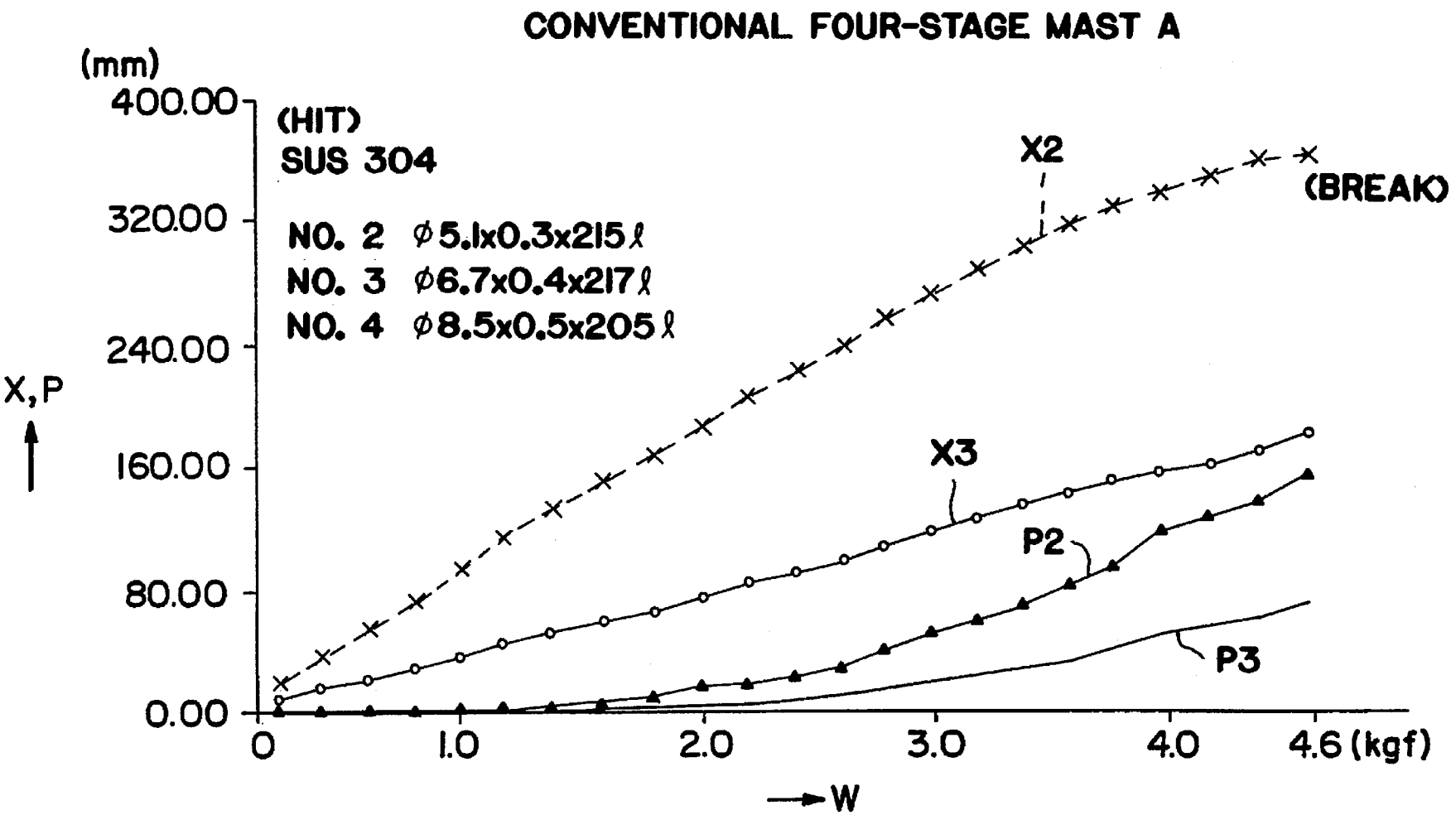
FIG. 8 is the test results obtained from sample f, which is a conventional sample, performed for the embodiment of the present invention.

As shown in FIG. 2, the base end of one of the conductive pipes 20 was supported on a fastening stand 30 with all the antenna elements connected except for the No. 1 rod or the uppermost rod. Then, the amount of bending X, that occurs when a load W is applied to the tip end of the No. 2 rod, and the amount of permanent deformation P, that occurs when the load W was removed, were obtained.

(3) Test Results

FIGS. 3 through 8 are graphs which show the obtained test results. As to the characteristic relationships shown in the graphs, the numerals appended to the respective amounts of bending X and the amounts of permanent deformation P represent the rod numbers. For example, X2 shows the amount of bending of the No. 2 rod, and P3 shows the amount of permanent deformation of the No. 3 rod. As is clear from these graphs, the conductive pipes 20 of the embodiments of the present invention that use SUS 631 material as seen in FIGS. 3 through 6 show an extremely small amount of permanent deformation P compared to the existing, conventional pipes that use SUS 304 material shown in FIGS. 7 and 8.

Furthermore, it was found that antennas with a smaller number of mast stages show less permanent deformation, and the effect of the high elasticity is more conspicuously obvious.

In addition, an actual car washing test was performed. The conventional samples showed bending or breakage after a single washing. On the other hand, the samples according to the embodiment of the present invention showed no damage even after ten washings, allowing smooth extensions and retractions to be conducted.

The present invention is not limited to the embodiments above. It goes without saying that various modifications are possible within the spirit of the present invention.

The present invention provides a multi-stage telescopic antenna and a method for manufacturing such an antenna for vehicles which has the special merits as described below:

(1) At least the conductive pipes are made from a high-elasticity material obtained by heat-treating the SUS 631 which is capable of great bending. Consequently, even if a large load is applied to the antenna element from a lateral direction, in other words, from a direction which crosses the axial direction of the antenna element, the antenna element as a whole can bend greatly in such a manner as a fishing rod. Accordingly, there is very little danger that the uppermost rod or conductive pipes that make up the antenna element will suffer any bending or breaking. Furthermore, there is almost no permanent deformation of the antenna element due to residual strain after the load is removed. Thus, the antenna element can always be maintained straight. Accordingly, extension and retraction of the antenna element can be performed stably.

(2) The conductive pipes are worked at a working rate of 20% or greater. Thus, the tensile strength and proof stress of the pipes are improved. Furthermore, since the pipes are subjected to a specific heat treatment, pipes with a sufficiently large elasticity can be obtained, and the pipes can be manufactured relatively easily and inexpensively.

We claim:

1. A method for manufacturing a multi-stage telescopic antenna for use in vehicles characterized in that said method comprises:

a pipe manufacturing process in which band-form pieces of SUS 631 material are curled into a pipe form and welded;

a pipe shaping process in which an external diameter and plate thickness of said pipes formed in said pipe manufacturing process are worked until the sum of an "external diameter working rate" and "plate thickness working rate" is 20% or greater, after which said pipes are cut to prescribed lengths so as to shape pipes; and a heat treatment process in which said pipes shaped in said pipe shaping process are heat-treated at a standard temperature of 480° C.±5° C. and then gradually cooled.

* * * * *